US005842681A

United States Patent [19]

Sisk

[11] Patent Number: 5,842,681

[45] Date of Patent: Dec. 1, 1998

[54] PIVOTAL HOPPER TEE WITH ALIGNABLE SWING-AWAY HOPPER TEE ASSEMBLY

[76] Inventor: David E. Sisk, 7353 Hillsboro Rd., Bonne Terre, Mo. 63628

[21] Appl. No.: 605,473

[22] Filed: Feb. 26, 1996

[51] Int. Cl.[6] ..... F16L 37/28

[52] U.S. Cl. ..... 251/144; 251/107; 251/114; 137/614.06

[58] Field of Search ..... 251/107, 111, 251/113, 114, 149.9; 137/614.06, 144

[56] References Cited

U.S. PATENT DOCUMENTS

| | | | |
|---|---|---|---|
| D. 283,265 | 4/1986 | Preskey et al. . | |
| D. 291,480 | 8/1987 | Vassallo et al. . | |
| D. 297,678 | 9/1988 | Sisk . | |
| D. 358,202 | 5/1995 | Sisk . | |
| 1,255,562 | 2/1918 | Olson . | |
| 1,901,016 | 3/1933 | West et al. | 251/111 |
| 2,039,542 | 5/1936 | Lindquist . | |
| 2,470,499 | 5/1949 | Lapp . | |
| 3,245,725 | 4/1966 | Wildman, Jr. . | |
| 4,030,524 | 6/1977 | McMath et al. | 137/614.06 |
| 4,047,741 | 9/1977 | Pertriaux . | |
| 4,678,159 | 7/1987 | Gardner et al. | 251/107 |
| 4,809,948 | 3/1989 | Gardner et al. | 251/144 |
| 4,848,396 | 7/1989 | Sisk . | |
| 4,889,318 | 12/1989 | Sisk . | |
| 5,104,155 | 4/1992 | Kirkwood . | |
| 5,387,015 | 2/1995 | Sisk . | |

FOREIGN PATENT DOCUMENTS

| | | | |
|---|---|---|---|
| 285156 | 3/1929 | France . | |
| 244795 | 2/1926 | Italy | 251/114 |
| 28708 | 3/1909 | United Kingdom . | |
| 156609 | 1/1921 | United Kingdom | 251/114 |

*Primary Examiner*—A. Michael Chambers
*Attorney, Agent, or Firm*—Paul M. Denk

[57] ABSTRACT

A swing-away hopper tee assembly for attachment at the discharge end of a hopper. The hopper tee assembly has a mounting frame for attachment at the discharge opening of the hopper. The mounting frame associates with alignment pins on a bottom side for alignment of a valve housing. The valve housing is positioned below the mounting frame and receives the alignment pins. The valve housing cooperates with alignment pins of the hopper tee. The hopper tee is pivotally attached to the mounting frame by a pair of adjustable pivot arms and extends below the valve housing. The hopper tee has a camming handle and hook assembly on the front side. The hooks extend upward and engage slots on the mounting frame. The camming handle can be locked into place securing the hooks in the mounting frame and effectively securing the valve housing between the hopper tee and mounting frame. The handle can be rotated over the center to lift the hooks away from the mounting frame and allow the hopper tee to swing away from the valve housing. The valve housing then can be removed and the assembly effectively cleaned.

13 Claims, 4 Drawing Sheets

PIVOTAL HOPPER TEE WITH ALIGNABLE SWING-AWAY HOPPER TEE ASSEMBLY

BACKGROUND OF THE INVENTION

This invention relates generally to hopper tees and, more specifically, to a low-profile, swing-away hopper tee and valve assembly.

Hoppers or tank trailers commonly are used to transport bulk commodities such as industrial and food products. When the hopper or tank trailer reaches its destination, the bulk commodity is unloaded. Typically this is done by pneumatically unloading the bulk commodity from the hopper into a clean and sanitary pipe line. For this purpose, hopper tees are mounted to the discharge outlet of the hopper truck. The hopper tee conventionally has a vertical section and a horizontal section forming the tee configuration. To transfer the bulk commodity, the material is moved out of the hopper by gravity flow or air pressure vibration into the vertical section of the hopper tee. The clean pipe discharge pipe is connected to the horizontal section of the tee. Pneumatic conveyance of the material through the pipe is accomplished by establishing a pressure differential in the pipe.

Prior art hopper tees have been constructed by welding vertical and horizontal pipe sections together. Such tees are prone to excessive wear and failure. Previously I have addressed such problems of wear. My U.S. Pat. No. 4,848,396 discloses a cast hopper tee designed to provide a smooth and uninterrupted internal transitional surface. My U.S. Pat. No. 5,387,015 provides for a hopper tee having an elliptical opening and a pair of wear saddles creating double wall thicknesses at the transition areas between the vertical and horizontal pipes.

Although my prior art hopper tees function well for their intended purposes, there are several problems associated with the prior art hopper tees. The prior art hopper tees are formed as a complete, one piece unit having a vertical section and a horizontal section. The hopper tees are designed to fit on the bottom of pneumatic tank trailers. The valve and the hopper tee are bolted to a flange. To remove the hopper tee the bottom line piping and the valve must be removed. The user must use wrenches to unbolt 4, 6 or 8 bolts that hold the hopper tee, the valve and the line to the bottom of the hopper. An excessive amount of time is used to perform such a task.

Further, when the user is washing the trailer and changing product, for example, changing from a load of black plastic pellets to white plastic pellets, just one black plastic pellet can contaminate a complete bin of white plastic pellets. Likewise, one kind of residual polymer can contaminate an entire load of different polymer. To ensure that there is no contaminants left in the hopper tee, valve or line, the entire assembly must be unbolted and removed. The area is cleaned and then reassembled. This is time consuming and costly, as aforesaid.

Since conventional hopper tees are constructed as one piece and must be unbolted to be removed from the line, it would be advantageous to have a hopper tee that can be opened without removal of bolts to allow access to the interior of the tee for complete emptying and cleaning.

Furthermore, some prior art hopper tees do not afford proper ground clearance. Ground clearance has been a problem in the tank industry for years. There are established heights, widths and lengths that tanks must meet by Department of Transportation (DOT) specifications. When the hauler is handling light density products, such as plastic pellets, he needs a larger cubic foot capacity to haul a maximum payload and make hauling such products economically feasible. To increase the cubic foot capacity and still stay within DOT height, width and length standards, you need to drop the bottom of the hopper and increase capacity. However, the bottom of the hopper must be designed with angled walls (angle of repose) that funnel down to the hopper tee to allow for emptying. For more dry bulk products the angle of repose needs to be approximately 45° to obtain the maximum cubic foot capacity while remaining within the mandated dimensions. Since the hopper tee is mounted below the tank it is obvious that ground clearance problems can arise. For example, when crossing railroad tracks or other uneven surfaces, every inch of ground clearance is important. In the past, tank manufacturers have tried a 30° angle of repose. However, such hoppers, because of their lesser incline, do not unload well. Some manufacturers have used a hopper having a 45° angle of repose down to the aeration devices and then change the angle to 30° which gains a few inches in ground clearance.

It would be advantageous, therefore, to have a hopper tee that can be removed or opened for cleaning esily and convenientyly without the necessity of unbolting. Furthermore, it would be advantageous to have such a hopper tee that has a low profile or can be attached to a hopper having either a 30 degree or 45 degree angle of repose.

SUMMARY OF THE INVENTION

It is, therefore, among the principal objects of the present invention to provide a hopper tee and valve assembly that can be opened to allow complete access to the interior for discharge and cleaning of product from the inside of the hopper tee.

Another object of the invention is to provide such a hopper tee and valve assembly that can be opened and moved away from the hopper without necessitating the time consuming task of unbolting a plurality of bolts.

It is another object of the invention to provide such a hopper tee and valve that can be dropped down by uncamming one side and letting the tee pivot away from the discharge valve and allow extrication of the discharge or butterfly valve for cleaning.

Another object of the present invention is to provide such a hopper tee and valve assembly that is readily aligned and mounted on the hopper flange.

Still another object of the invention is to provide such a hopper tee and valve assembly which provides an even and constant product flow first through the vertical and then the horizontal pipe sections of the hopper tee.

Yet another object of the invention is to provide such a hopper tee and valve assembly that is easily and economically constructed, fascile to mount and use and well suited for its intended purposes.

In accordance with the invention, briefly stated, a hopper tee and valve assembly is provided that is pivotally attached to the bottom of the hopper and secured by a pair of cammed latching hooks. The invention includes a mounting frame that attaches to the bottom exterior of the hopper. The mounting frame has a forward pair of alignment pins, and also has a rearward pair of corresponding alignment pins. The butterfly valve housing is designed to attach to the mounting frame. The valve housing has a series of bores through its housing to accommodate the pins therethrough, so that they can engage within shallow bores for alignment on the upper part of the said mounting frame. The hopper tee has a horizontally extending hollow pipe and an integral flange on the upper surface. The upper surface of the flange has two pairs of upwardly extending alignment pins that seat in the bores in the mounting frame. There are a pair of spaced pivot arms that extend downwardly between the rear of the mounting frame and the rear of the hopper flange. There are a pair of spaced apart, cam operated, locking hooks pivotally attached to the front of the hopper tee. These hooks are designed to engage the mounting frame and be locked into place by an over center camming action. The hooks can be released allowing the hopper tee to pivot about the pivot arms downwardly away from the butterfly valve housing. The valve housing can be disengaged from the mounting frame for cleaning. The valve housing then is attached to the mounting frame by aligning the pins. The hopper tee is aligned with the valve housing via the alignment pins. The hooks engage the mounting frame and cammed down into a locked position. The hopper tee biases the valve housing against the mounting frame and the discharge end of the hopper to seal the assembly. But in doing so, complete alignment of these components is maintained.

Other objects and features of this invention will become apparent from the description that is to follow.

DESCRIPTION OF THE PREFERRED EMBODIMENT

Figure 1:
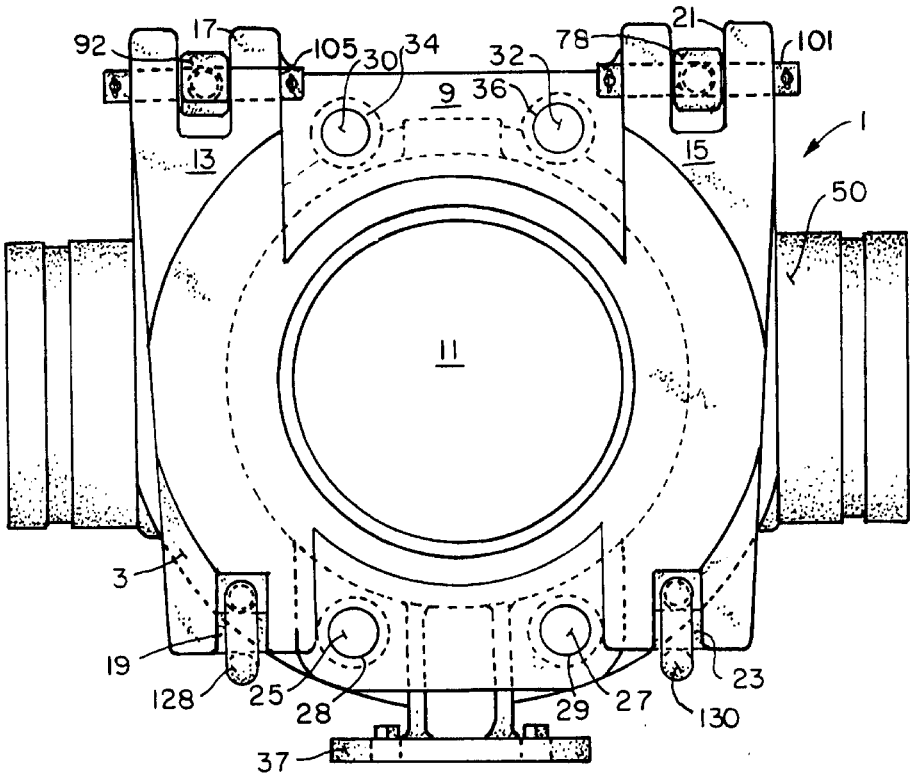
FIG. 1 is a top plan view of the swing-away hopper tee and valve assembly of the present invention.

One of the principal areas of use of the swing-away hopper tee and valve assembly of the present invention is shown in the drawings. The assembly, indicated generally by reference numeral 1 is positioned adjacent and connected to the discharge outlet (See FIG. 2) of hopper 2. The assembly 1 has three major components, a mounting frame 3, a butterlfy valve and housing assembly 5, a hopper tee 7 and the hopper tee camming lock assembly 8. Each of the various components will be described in detail hereinafter.

Figure 2:
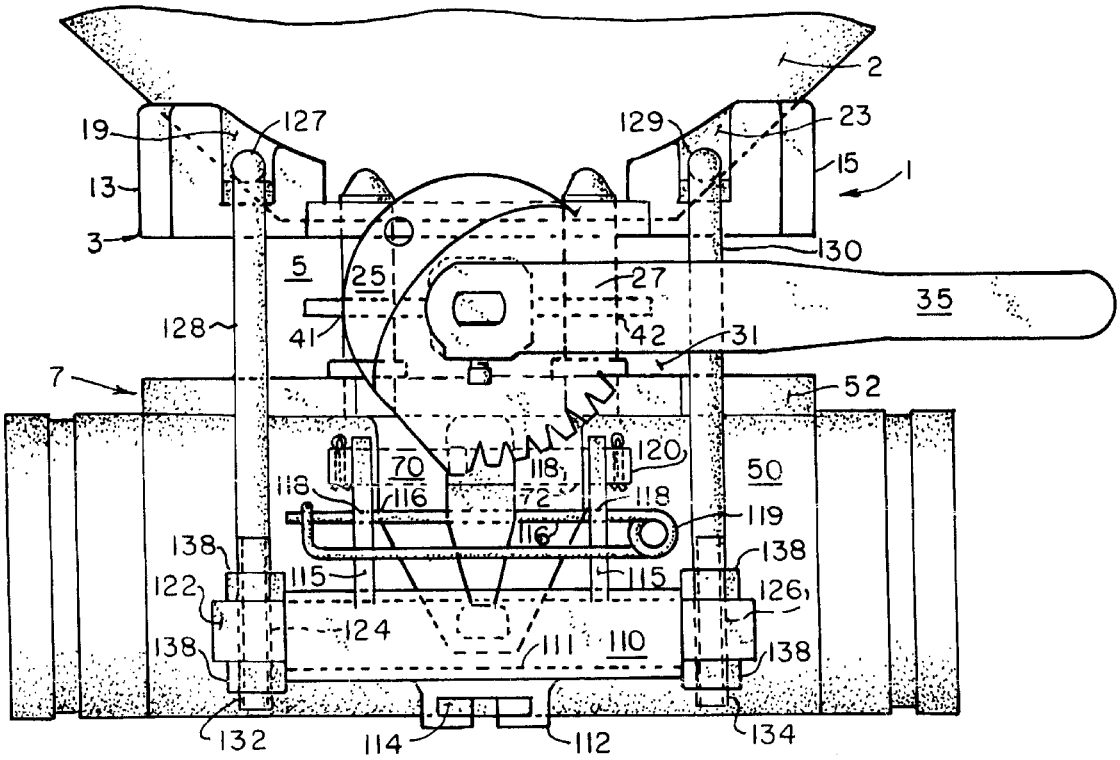
FIG. 2 is a side elevational view thereof, shown attached to a trailer hopper to indicate environment.
Figure 3:
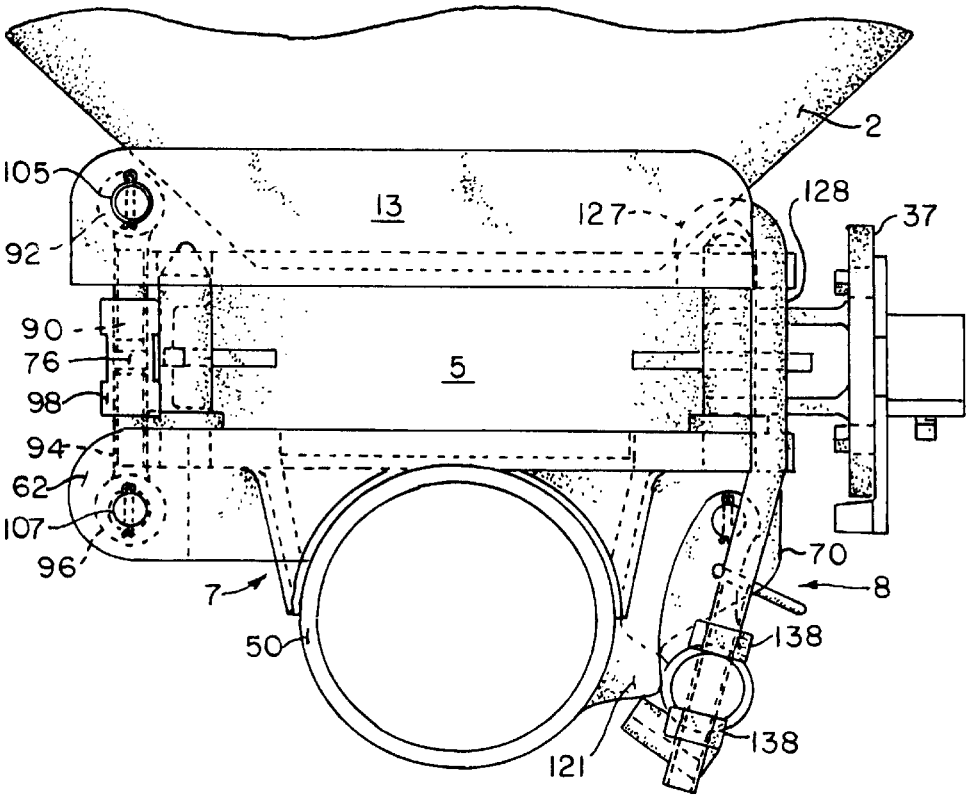
FIG. 3 is a front elevational view thereof.

The mounting frame 3 is attached to the hopper 2 adjacent the discharge opening (See FIG. 2). As indicated in FIG. 1, the mounting frame has a circular flange 9 with a central opening 11 that surrounds the dischrge opening of the hopper 2. The flange can be preferably welded or otherwise appropriately attached to the hopper. There is a first beam 13 extending along one upper side of the flange and a second, spaced apart parallel beam 15 that extends along the opposite side of the flange. These are for reinforcement purposes. As can be seen in FIGS. 1 and 2, there is a channel or slot 17 formed in a first or rear end of beam 13 and a notch 19 formed in the second or front end. There is a channel or slot 21 formed in the first or rear end of beam 15 and a notch 23 formed in the second or front end. The respective slots are designed to accommodate the end of a pivot arm and the respective notches are designed to accept a latching hook, as will be explained in greater detail below. As seen in FIGS. 1 and 3, there is a pair of spaced apart alignment pins 25 and 27 that fit into alignment apertures 28 and 29 formed into the front of flange 9. In addition, there is a pair of spaced apart rear alignment pins 30 and 32, mounted upon the tee 7, that fit into alignment apertures 34 and 36 formed into the rear of the flange 9, as can be noted in FIG. 1.

Figure 4:
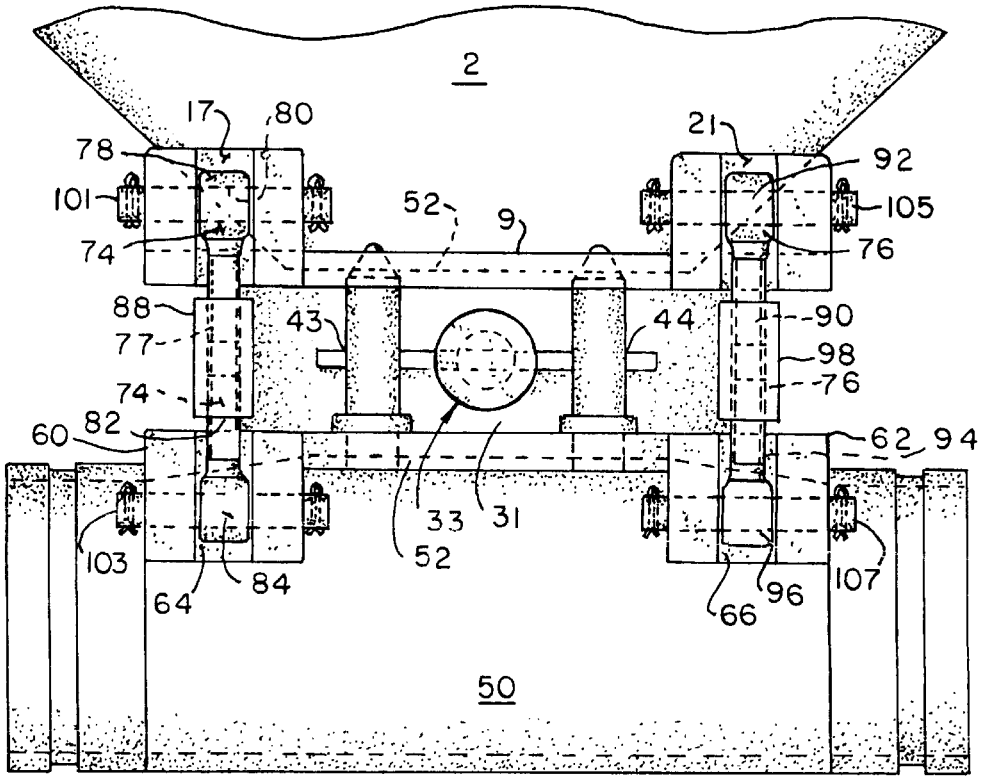
FIG. 4 is an opposite side elevational view thereof.
Figure 6:
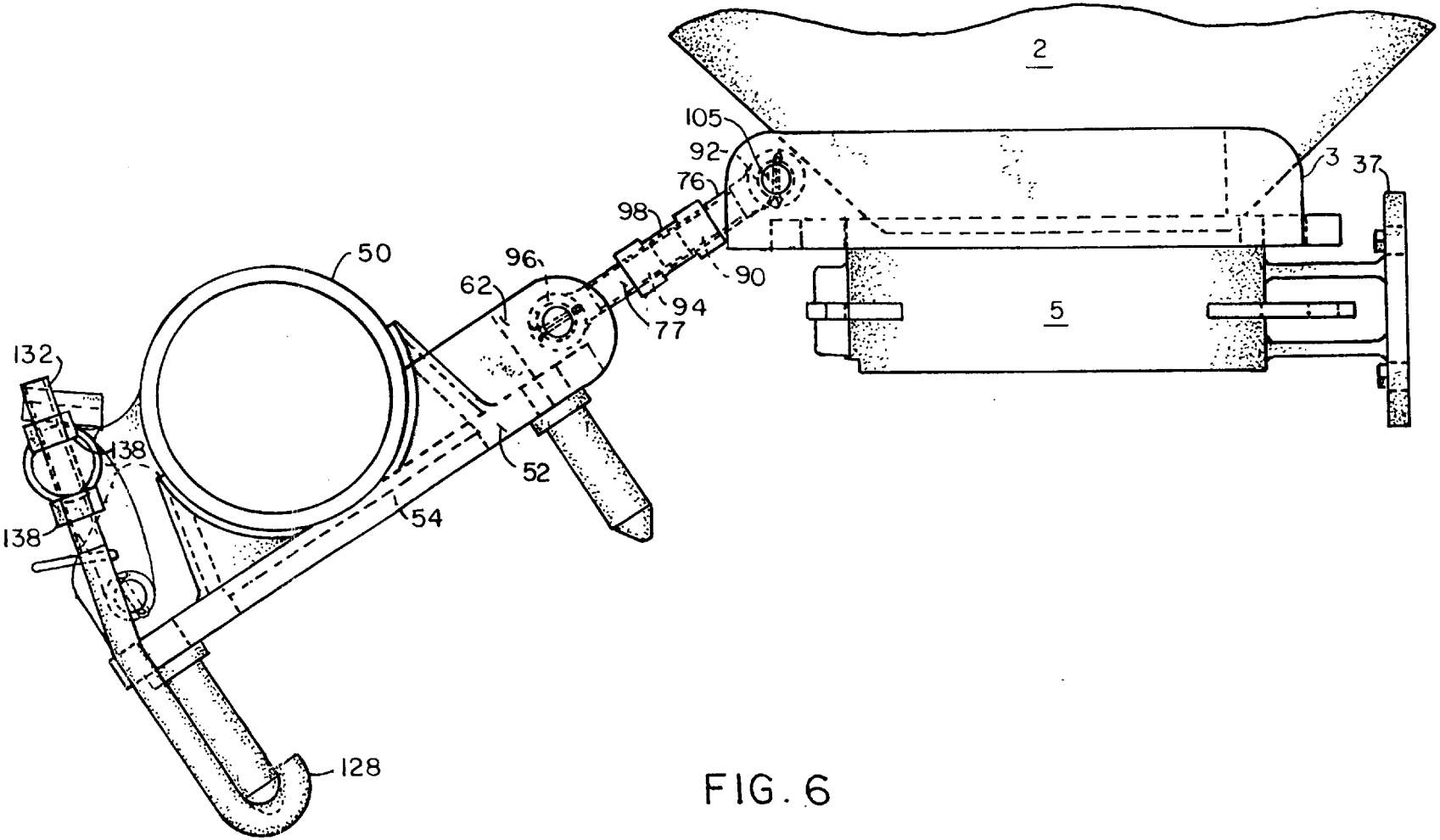
FIG. 6 is a similar view to FIG. 5, with the hooks disengaged and the hopper tee swung completely away to allow removal of the valve assembly.

The butterfly valve and its housing assembly 5 is positioned adjacent the bottom side of the mounting frames. Assembly 5 has a housing 31 with a butterfly valve 33, as shown in FIG. 4, therein. The valve 33 is manually actuated by the external valve handle 35 attached to a handle mounting flange 37. (See FIG. 6). The rotation of handle 35 effects the movement of valve 33 to control flow of material out of the hopper and through the assembly.

There are four spaced apart alignment pin clearance slots 41 through 44 formed through or adjacent the housing 31. Bores 41 through 44 align with and are complementary to the four alignment pins 25 and 27, respectively, of the flange 52. The rear alignment pin bores 45 and 47 are formed through or adjacent the housing 31 to accept the alignment of the pins on the hopper tee, as will be explained below. When assembled, as shown, the pins nest into the bores.

Figure 5:
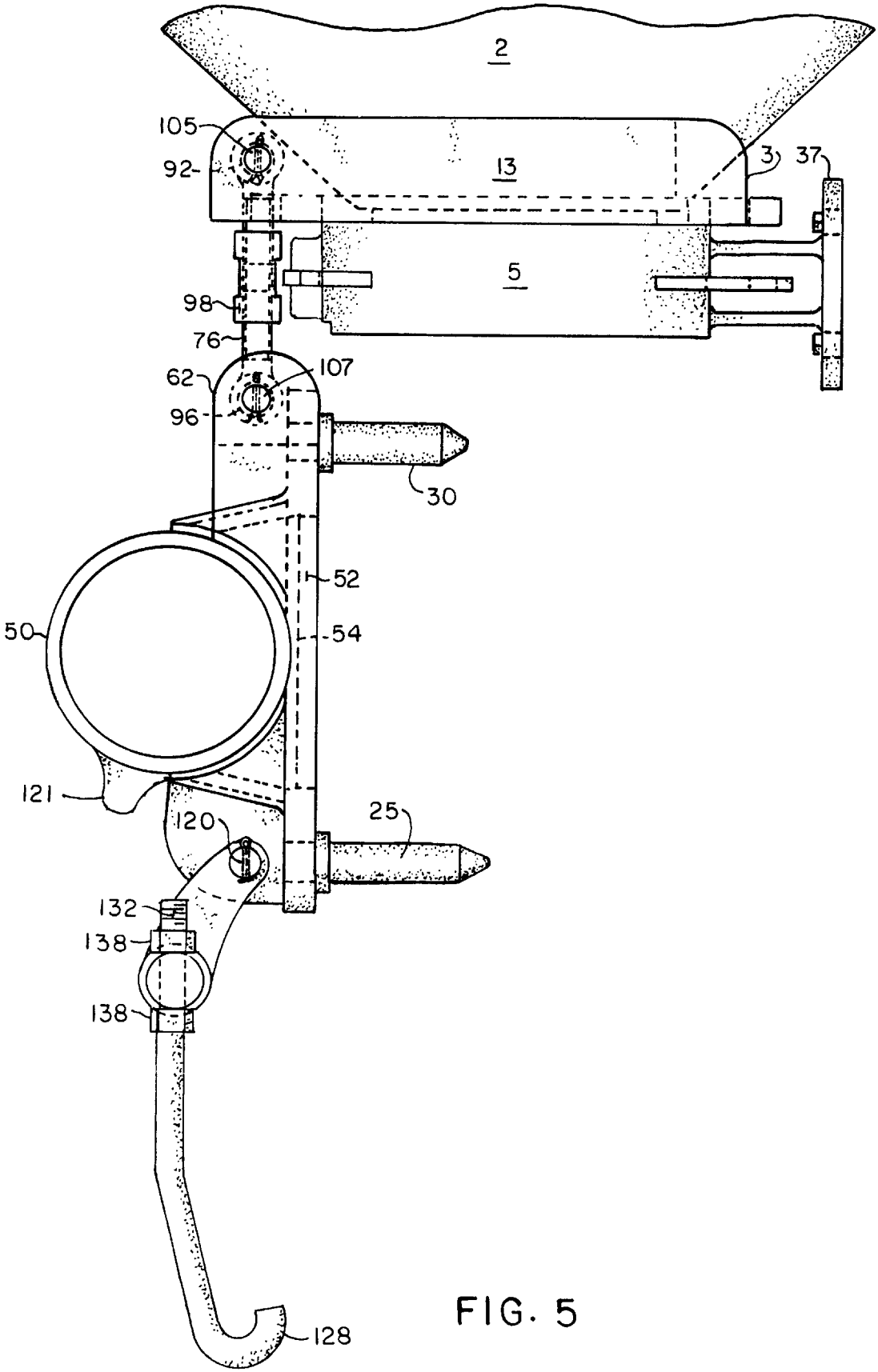
FIG. 5 is a rear elevational view thereof, the hooks disengaged and the hopper tee pivoted downwardly and swung away.

The hopper tee 7 is positioned adjacent the valve housing. The hopper tee 7 has a conventional elongated hollow pipe section 50. There is an integral flange 52 surounding an inlet opening 54 through the top surface of the pipe. (See FIG. 5.) There are two pairs of spaced apart, upwardly disposed alignment pins 25 and 27 on the front upper surface of flange 52. The pins 30 and 32 extend upwardly from the rear upper surface of said flange 52. When assembled, these pins nest in their respective bores as described above. There are a pair of spaced apart rear pivot bosses 60 and 62 extending out from the pipe under or adjacent the flange 52. The bosses have slots 64 and 66 respectively formed therein. There are a pair of spaced apart front handle positioning bosses 70 and 72 extending out from the pipe under flange 52. (See FIG. 2).

Hopper tee 7 is pivotally connected to mounting frame 3 by a pair of adjustable pivot arms 74 and 76. (See FIG. 4). Pivot arm 74 has a substantially cylindrical first segment 77 having a substantially flat circular end 78 with a hole 80 formed centrally therein and a second cylindrical segment 82 having a substantially flat circular end 84 also with a hole formed centrally therein. The segments, except for the ends, are threaded and joined by a threaded hex nut 88 to allow adjustment to the length of the arm. Pivot arm 76 has a first cylindrical segment 90 with a substantially flat rounded end 92 and a second cylindrical segment 94 with a substantially flat rounded end 96. The segments also are externally threaded and are adjustably connected with a hex nut 98. End 78 is inserted in slot 17 and held in place by a pivot pin 101. End 84 is inserted in slot 64 and held in place by a pivot pin 103. End 92 is inserted in slot 21 and held in place by pivot pin 105 while end 96 is inserted in slot 66 and held in place by pivot pin 107. The hopper tee swings away from the valve housing about the pivot to be completely opened and cleaned, (See FIGS. 4, 5 and 6) and is then swung back and locked into place (See FIG. 3) with the camming lock assembly 8, as will now be explained.

The camming lock assembly 8 is shown in greater detail in FIGS. 2 and 3. The assembly 8 has a generally horizontal handle 110. Handle 110 has a horizontal bore 111 formed therethrough. Handle 110 has a downwardly protruding member or lobe 112 with a substantially arranged bore 114 formed therethrough. Bore 114 is dimensioned to allow the insertion of a pry tool (not shown) or pipe for leverage. Extending upwardly from the handle 110 are integral members 115 which pivotally mount upon the pivot pin 120. These members 115 are designed for straddling the positioning bosses 70 and 72 of the hopper tee 7, as previously explained. Thus, when the cam lock assembly 8 is arranged in the position as shown in FIG. 2, and the handle 110 is forcefully pivoted downwardly, into its over center position, adjacent the lower surface of the hopper tee 7, the handle members 115 straddle the positioning bosses 70 and 72, adjacent their sides, and since each of these members have an aperture, as at 116, provided therethrough, in addition to the integral members 15 having aligned apertures 118 arranged therethrough, a locking pin 119 can be inserted, engaged, for locking the cam locking assembly into disengagement position. When that occurs, the butterfly valve housing 5 and the hopper tee 7 will be aligned and locked into position for usage. But, when the pin 119 is removed, the handle 110 may be pulled forwardly, to its unlocked position, at which time the cam locking assembly 8 may be disengaged from the hopper 2, as to be subsequently described.

There is a pivot pin 122 in bore 111. The ends of the pin 122 extend beyond handle 110. There is a bore 124 through one end of pin 122 and a bore 126 through the opposite end of the pin. A first elongated hook 128 is attached to one end of pin 122 and second elongated hook 130 is attached to the opposite end of the pin. Hooks 128 and 130 have threaded ends 132 and 134 which are inserted through bores 124 and 126 respectively. The relative length of the hooks can be adjusted by the threaded hex nuts 138 which secure the threaded ends of the hooks in the ends of the pivot pin. The hooks 128 and 130 are dimensioned at their upper ends 127 and 129 so that these hooked ends seat in the notches 19 and 23 of the mounting frame 3 when the hopper tee is located into its working position against the valve housing, as shown in FIGS. 2 and 3.

In use, the mounting frame 3 is appropriately attached to the bottom of the hopper. The butterfly valve and housing 5 are positioned against the bottom of frame 3. Bores 41 through 44 align with and accept alignment pins 25, 27, 30 and 32, to quickly and appropriately position the valve housing when the hopper tee 7 is swung up, pivoting on the pivot arms 74 and 76. Handle 110 is manipulated upward so the hooked ends 127 and 129 of the securing hooks 128 and 130 extend above the mounting frame 3, for clearing into the slots 19 and 23 respectively. The handle 110 is forced down and cams about camming lobe 121 pulling the hooks tightly into the slots 19 and 23. Once handle 110 moves over center, the hooks are biased down into the slots, and the locking pin 119 may be inserted. The valve housing is effectively locked, aligned, and positioned between the hopper tee and the mounting frame.

To dismantle the assembly for cleaning, the pry bar is inserted into bore 114 in handle 110 and upward pressure applied. The handle cams back off from the lobe 121 and provides looseness to the hooks 128 and 130 for movement out of the slots 19 and 23. The hopper tee then can be swung and moved down and away from the valve housing and the valve housing physically removed from the mounting frame. Each component of the assembly can be thoroughly cleaned of residue. The assembly then is quickly reassembled as described above. The employment of the alignment pins and pivot arms allow for a relative swift and accurate positioning, assembly and disassembly of the hopper tee.

It will be apparent to those skilled in the art that various changes and modifications may be made in the swing-away hopper tee assembly just described without departing from the scope of the appended claims. For example, the pins may extend down from the flange. Therefore, the foregoing description and accompanying drawings are to be viewed as illustrative only and should not be construed in a limiting sense.

I claim:

1. A swing-away hopper tee assembly for attachment to a discharge opening in a hopper comprising:

a mounting frame assembly for attachment at the discharge opening of the hopper;

a valve housing assembly below the mounting frame, the valve housing assembly removably receiving a flow control valve;

a hopper tee positioned below the valve housing assembly and having an opening through which material can flow from the flow control valve, the hopper tee being pivotally attached to the mounting frame assembly for movement between a first closed position in which said hopper tee opening is in fluid communication with said flow control valve and a second opened position in which said hopper tee is out of alignment with said flow control valve to expose said flow control valve to enable the flow control valve to be removed from the valve assembly housing;

a first alignment member on said hopper tee and a second alignment member on one of said mounting frame and valve housing assembly, said first and second alignment members cooperating with each other to align the hopper tee opening with the flow control valve;

a camming means and engagement assembly for releasably securing the hopper tee to the mounting frame; the camming means and engagement assembly including:

a locking member movable between an unlocked position in which said hopper tee can be pivoted away from its first to its second position to expose said flow control valve and a locked position to secure said hopper tee in said first position; and a cam for securing the locking member in the locked position.

2. The assembly of claim 1 further comprising a pair of elongated pivot arms extending between the mounting frame assembly and the hopper tee to allow the hopper tee to swing away from the valve housing assembly and the mounting frame assembly to allow access to the hopper tee and removal of the valve.

3. The assembly of claim 1 wherein the locking member of the camming means and engagement assembly comprises a pair of spaced-apart, elongated securing hooks that extend from a pivotable handle to engagement means on the mounting frame, said hooks being operatively connected at one end to one of said hopper tee and said frame assembly and having a hook end at another end which engages the other of said hopper tee and frame assembly to hold said hopper tee in said first position.

4. The assembly of claim 2 wherein the pivot arms are adjustable in length.

5. The assembly of claim 3 wherein the securing hooks are adjustable in length.

6. The assembly of claim 1 wherein said first alignment member mounts upon the hopper tee and generally extends upwardly therefrom, when the assembly is secured to the hopper.

7. The assembly of claim 6 wherein said first alignment member comprises a series of upwardly extending alignment pins, and said second alignment member comprises pin receiving openings.

8. The assembly of claim 7 wherein there are at least two alignment pins forming the first alignment member.

9. The assembly of claim 8 wherein there are four alignment pins extending from the hopper tee.

10. A swing-away tee assembly for attachment to the discharge end of a hopper comprising:

a mounting frame and hopper tee attached at the discharge end of the hopper having alignment means operatively associated therewith for the positioning of a valve housing;

a valve housing removably attached to the mounting frame and hopper tee at the alignment means, the valve housing having a flow control valve therein, the valve housing also cooperating with the alignment means for accommodation of the alignment means of the mounting frame and hopper tee and for the positioning of said hopper tee;

said hopper tee being pivotally attached to the mounting frame with a pair of pivot arms, the hopper tee positioned below the valve housing and having said alignment means thereon for positioning with the alignment means of the valve housing; and a camming handle assembly pivotally attached to the hopper tee, the camming handle having a pair of spaced apart, elongated hooks disposed to engage latching means on the mounting frame when the hopper tee is in a first or locked position, and said camming handle being movable about an over center position to allow the disengagement of the hooks from the latching means so as to allow the hopper to pivot about the pivot arms to a second or open position.

11. The assembly of claim 10 wherein the valve housing is biased into a secured aligned position between the hopper tee and the mounting frame when the hopper tee is in the first position and can be removed from the mounting frame by disengagement of the alignment means when the hopper tee is in the second position.

12. The assembly of claim 3 wherein the cam includes a camming handle having a pair of legs pivotally connected to said hopper tee and a grip extending between said legs; said handle being pivotal toward and away from said frame assembly; said locking hooks being pivotally connected to said handle, whereby movement of said handle away from said frame assembly secures the latching of said hooks to said frame assembly when said hopper tee is in its first position, and movement of said handle toward said frame assembly loosens the latching of said hooks to said frame assembly when said hopper tee is in its first position.

13. The assembly of claim 3 wherein said hooks are unitary, one-piece hooks.

* * * * *